United States Patent [19]

Metzger et al.

[11] 4,035,148

[45] July 12, 1977

[54] CARPET CLEANING AND SOIL REPELLENT COMPOSITIONS

[75] Inventors: Carroll A. Metzger; Fred M. Habermehl III, both of Hamilton; Ned C. Webb, West Chester, all of Ohio

[73] Assignee: The Procter & Gamble Company, Cincinnati, Ohio

[21] Appl. No.: 683,584

[22] Filed: May 6, 1976

[51] Int. Cl.[2] ..... C11D 7/16; C11D 17/20; D06M 11/08; D06M 11/12

[52] U.S. Cl. ..... 8/137; 134/4; 134/21; 252/88; 252/89 R; 252/90; 252/135; 252/140; 252/173; 252/DIG. 14; 427/350; 427/372 R; 427/390 E

[58] Field of Search ..... 8/137; 134/4, 21; 252/88, 109, 135, 140, 173, DIG. 14, 90, 89; 427/350, 390 E, 372, 394

[56] References Cited

U.S. PATENT DOCUMENTS

| | | | |
|---|---|---|---|
| 3,716,488 | 2/1973 | Kolsky | 252/155 |
| 3,736,259 | 5/1973 | Buck | 252/89 |
| 3,748,268 | 7/1973 | Loudas | 252/90 |
| 3,775,052 | 11/1973 | Van Paassen | 8/137 |
| 4,002,571 | 1/1977 | Anderle | 252/90 |

FOREIGN PATENT DOCUMENTS

| | | | |
|---|---|---|---|
| 985,113 | 3/1976 | Canada | 252/90 |

OTHER PUBLICATIONS

"Rug Shampoo Makers Keep it Clean," *Chemical Week*, July 12, 1969, pp. 26–27.

Florio, P. A. et al.: "Control of Appearance Changes due to Soiling," Textile Research Journal, July 1955, pp. 641–649.

Hackett, W. J.: "Carpet Shampoos," *Household & Personal Products Industry*, July 1972, pp. 27–29.

Schuman, L. J. et al.: "Aerosol Rug Shampoo Soil Retardant," Soap & Chemical Specialties, Mar. 1970, pp. 43, 44, 46, 50, 70 & 71.

*Primary Examiner*—Dennis L. Albrecht

*Attorney, Agent, or Firm*—Charles R. Wilson; Julius P. Filcik; Richard C. Witte

[57] ABSTRACT

A substantially surfactant-free composition consists essentially of a water-soluble phosphate and a water-insoluble alumina having a particle size less than 3 microns. An aqueous mixture of the phosphate and alumina is useful for cleaning carpets and imparting a soil repellent finish thereto.

22 Claims, No Drawings

CARPET CLEANING AND SOIL REPELLENT COMPOSITIONS

BACKGROUND OF THE INVENTION

This invention relates to the cleaning of carpets and imparting a soil repellent finish thereto. More particularly, the invention relates to a substantially surfactant-free composition containing a phosphate and alumina.

Carpet cleaning compositions are well known. Generally such compositions contain a surfactant for removing soil from the carpet and optionally a soil repellent. The compositions are employed by the home user by means of a brush or use of a mechanical device, e.g. a rug shampooer. Such compositions do satisfactorily clean the carpet. Unfortunately, it is difficult to remove all of the surfactant from the carpet after its application. Since the surfactant is normally tacky, a tacky film forms on the carpeting. This, in effect, attracts and retains soil so that the net effect is a cleaned carpet will soil more easily after a cleaning than previous thereto. Various approaches have been offered to get around this problem. For example, embrittling agents have been included in carpet shampoos for the purpose of rendering the surfactant non-tacky. (See "Rug Shampoo Makers Keep It Clean", Chamical Week, July 12, 1969, pp. 26, 27.) Alumina monohydrate has also been suggested for use in surfactant-containing compositions to embrittle the surfactant for easier removal and retarding dirt pick-up. (See "Aerosol Rug Shampoo Soil Retardant", Schuman and Carlucci, *Soap & Chemical Specialties*, March, 1970, p. 43.) While such approaches have met with limited success, there is still a need for a carpet cleaning composition which effectively and efficiently cleans the carpets without causing a resoiling problem.

It is an object of this invention to provide a substantially surfactant-free carpet cleaning composition.

It is another object of this invention to provide a carpet cleaning composition which is able to clean carpets and simultaneously impart a soil repellent finish thereto.

Still another object of this invention is to provide a method of cleaning carpets and imparting a soil repellent finish thereto.

These and other objects will become apparent from the description to follow.

As used herein all percentages and ratios are by weight unless otherwise stated.

SUMMARY OF THE INVENTION

A substantially surfactant-free carpet cleaning and soil repellent composition consisting essentially of a water-soluble phosphate and a water-insoluble alumina having a particle size less than 3 microns in a ratio of from 1:1 to 1:25. A method of cleaning and imparting a soil repellent finish to carpets is also provided wherein an aqueous solution of the phosphate and alumina is applied to the carpet.

DETAILED DESCRIPTION OF THE INVENTION

The compositions of this invention comprise a substantially surfactant-free mixture of a water-soluble phosphate and a water-insoluble alumina. The compositions are applied from an aqueous medium to carpets.

As used herein "substantially surfactant-free" means less than 1% surfactant based on the phosphate-alumina mixture is found in the composition. Preferably, the composition is surfactant-free. The minor amount of surfactant can be included in the composition for the purpose of getting a desired sudsing, dispersing or solubilizing effect; the level of surfactant is such that a noticeable cleaning effect and tack problem are not obtained. The surfactant used is any of the known organic synthetic or non-synthetic anionic, cationic, nonionic, zwitterionic or ampholytic surfactants.

The water-soluble phosphate provides a cleaning function. The phosphate is any of the known water-soluble alkali metal and ammonium inorganic phosphates. Satisfactory examples thereof include sodium and potassium tripolyphosphate, tetrasodium, -potassium and -ammonium pyrophosphate, disodium dihydrogen pyrophosphate, mono-, di- and trisodium and mono-, di-, and tripotassium phosphate and sodium polymetaphosphate where the degree of polymerization ranges from 6 to 21. Sodium tripolyphosphate is preferred.

A hydrated or unhydrated alumina is included in the compositions herein. The physical form or structure of the alumina is not important, i.e. the alumina can be amorphous or crystalline and can have a high or low density. The alumina provides a soil repellent attribute to the carpet. It has been found an ultimate particle size of less than 3 microns is necessary to achieve a satisfactory soil repellent benefit. Preferably, the ultimate particle size of the alumina is from 0.005 microns to 0.1 microns. A particle size greater than 3 microns is undesirable because a stable aqueous suspension with the phosphate is not obtainable and because ordinary vacuuming will remove particles of alumina greater than 3 microns thereby eliminating the soil repellent effect. The ratio of water-soluble phosphate to alumina is from 1:1 to 1:25, preferably 1:3 to 1:6.

The phosphate-alumina mixture is applied to the carpets from an aqueous medium. An aqueous composition of proper concentration for use consists essentially of from 0.2% to 4%, preferably 0.5% to 1.5% of the phosphate, from 1% to 10%, preferably 3% to 6% of the alumina, and the balance water. A level of phosphate below 0.2% does not provide a satisfactory cleaning effect while a level greater than 4% provides no additional cleaning and is for this reason avoided. Satisfactory soil repellency is achieved at the level of 1% to 10% alumina without unsightly alumina deposition and vacuuming problems.

In one embodiment of the invention the aqueous composition is provided in the form of an aerosol. The quantity of propellant used in the aerosol is from 5% to 15% of the total composition. Any suitable propellant is used. Satisfactory propellants include the $C_{2-4}$ saturated aliphatic hydrocarbons and $C_{1-2}$ halogenated hydrocarbons, e.g. propane, butane, isobutane, trichloromonofluoromethane, dichlorodifluoromethane, trichlorotrifluoroethane and dichlorotetrafluoroethane.

The aqueous composition herein is applied to carpet in an amount to effectively remove soil and impart a soil repellent finish thereto. Generally from 50 cc composition per square meter carpet to 1000 cc composition per square meter carpet, preferably 200 to 350 cc composition per square meter carpet, is applied and preferably worked into the carpet with a brush, sponge or the like. Despite being substantially surfactant-free, the composition is able to lift soil from the carpet's fibers and suspend it. A subsequent drying and vacuuming removes the soil. Moreover, any phosphate which remains behind does not aid resoiling since it is non-tacky, contrary to many surfactant residues. The presence of the alumina provides the soil repellent effect.

The compositions herein are commercialized in an aqueous ready-to-use form consisting essentially of the phosphate, alumina and water at the proper carpet application levels or in a substantially dry or concentrated aqueous composition form to be diluted by the consumer prior to use. A concentrated aqueous composition consists essentially of from 0.8% to 12%, preferably 2% to 6% of the phosphate, from 4% to 40%, preferably 12% to 24% of the alumina and the balance water.

Optional components such as perfume, coloring matter, optical brighteners, germicides and deoderants can be included in the compositions of this invention.

The examples which follow illustrate the invention herein.

EXAMPLE I

The following compositions are tested for their carpet cleaning and soil repellent benfits.

| | Percent |
|---|---|
| Composition A | |
| * Alon | 5 |
| Sodium tripolyphosphate | 1 |
| Water | 94 |
| Composition B | |
| Sodium middle-cut coconut alkyl sulfate | 0.6 |
| Water | 99.4 |

* Alon is an amorphous alumina monohydrate having a particle size of 0.1 microns.

One inch nylon shag carpet, white in color, is placed in a high traffic hallway and exposed to normal traffic. The carpet is vacuumed daily. The carpet consists of three pieces of carpet attached together such that all three pieces are walked upon by a person using the hallway. The middle piece is used as a control. After 5 days the end pieces, measuring 45 cm by 65 cm, are individually cleaned using Compositions A and B. Composition A is applied to one piece of carpet at a rate of 270 cc per square meter with a twin brush rotary scrubber. Composition B is applied to the other piece of carpet at a rate of 538 cc per square meter with the twin brush rotary scrubber. Both areas of carpet are scrubbed for the same length of time and thereafter allowed to air dry.

Visual grading for degree of cleaning is done as a paired comparison test by a group of panelists. All gradings indicate either a slight preference or no preference for the carpet cleaned by the composition of this invention, i.e. Composition A.

The degree of resoiling of the above carpets are determined as follows. The carpets, after grading, are again placed in the high traffic location for additional exposure to natural soiling. The carpets are vacuumed daily. After a period of 5 days the carpets are graded using the method described above. In all instances, there is a definite preference for the carpet cleaned initially by Composition A.

This test indicates the composition of this invention cleans on a par with the prior art composition, but does not resoil as fast as the prior art composition.

EXAMPLE II

The following compositions are tested.

| | Percent |
|---|---|
| Composition A | |
| Alumina monohydrate | 5 |
| Sodium tripolyphosphate | 1 |
| Water | 94 |
| Composition B | |
| Sodium lauryl sulfate | 4.7 |
| Methyl methacrylate-styrene copolymer | 4.9 |
| Ammonia | 0.2 |
| Sodium tripolyphosphate | 0.9 |
| Isobutane | 6.5 |
| Water | Balance |

The alumina monohydrate of Example I is used.

Pieces of 1 inch nylon shag carpet are sprayed with Composition A at a rate of 270 cc per square meter and Composition B until an even foam develops. The treated areas are scrubbed with a wet scrub brush for about two minutes. Both areas are allowed to air dry, vacuumed and are then graded as in Example I. The carpet cleaned by Composition A is on a par with that cleaned by Composition B with respect to degree of cleaning. However, upon resoiling and regrading (as in Example I), the carpet initially treated with Composition A is definitely preferred over that initially treated with Composition B.

The following examples further illustrate the compositions of this invention. The aluminas of Examples III-VII have a particle size of 0.1, 3, 1, 0.09, and 0.1 microns, respectively.

EXAMPLE III

| | |
|---|---|
| Alumina monohydrate | 5 parts |
| Potassium tripolyphosphate | 1 part |

EXAMPLE IV

| | Percent |
|---|---|
| Alumina monohydrate | 20 |
| Trisodium phosphate | 4 |
| Water | 76 |

EXAMPLE V

| | Percent |
|---|---|
| Alumina (anhydrous) | 15 |
| Trisodium pyrophosphate | 3 |
| Disodium phosphate | 3 |
| Water | 79 |

EXAMPLE VI

| | Percent |
|---|---|
| Alumina monohydrate | 3.5 |
| Sodium tripolyphosphate | 0.5 |
| Water | 96.0 |

EXAMPLE VII

| | Percent |
|---|---|
| Alumina monohydrate | 8.0 |
| Sodium tripolyphosphate | 2.5 |
| Water | 89.5 |

The substantially dry and concentrated compositions of Examples III, IV, and V are diluted with water prior to actual use. All of the illustrated compositions clean satisifactorily and provide a satisfactory soil repellent finish to carpet.

What is claimed is:

1. A substantially surfactant-free composition useful for cleaning of carpets and imparting thereto a soil repellent finish consisting essentially of:

a. a water-soluble phosphate, and b. a water-insoluble particulate alumina having an ultimate particle size less than 3 microns;

wherein the ratio of phosphate to alumina is from 1:1 to 1:25 and wherein the composition contains less than 1% surfactant based on the phosphate-alumina mixture.

2. The composition of claim 1 wherein the water-soluble phosphate is an alkali metal or ammonium inorganic phosphate.

3. The composition of claim 2 wherein the ratio of phosphate to alumina is from 1:3 to 1:6.

4. The composition of claim 3 wherein the particle size of the alumina is from 0.005 microns to 0.1 microns.

5. The composition of claim 4 wherein the phosphate is sodium tripolyphosphate.

6. The composition of claim 1 wherein the composition is surfactant-free.

7. A concentrated aqueous substantially surfactant-free carpet cleaning and soil-repellent composition consisting essentially of:

a. from 0.8% to 12% of a water-soluble phosphate;

b. from 4% to 40% of a water-insoluble particulate alumina having an ultimate particle size less than 3 microns; and c. the balance water wherein the composition contains less than 1% surfactant based on the phosphate-alumina mixture.

8. The composition of claim 7 wherein the phosphate is an alkali metal or ammonium inorganic phosphate.

9. The composition of claim 8 consisting essentially of:

a. from 2% to 6% of the water-soluble phosphate;

b. from 12% to 24% of the water-insoluble particulate alumina; and c. the balance water.

10. The composition of claim 9 wherein the alumina has a particle size of from 0.005 microns to 0.1 microns.

11. The composition of claim 10 wherein the phosphate is sodium tripolyphosphate.

12. The composition of claim 7 wherein the composition is surfactant-free.

13. An aqueous ready-to-use substantially surfactant-free carpet cleaning and soil repellent composition consisting essentially of:

a. from 0.2% to 4% of a water-soluble phosphate;

from 1% to 10% of a water-insoluble particulate alumina having an ultimate particle size less than 3 microns; and c. the balance water wherein the composition contains less than 1% surfactant based on the phosphate-alumina mixture.

14. The composition of claim 13 wherein the phosphate is an alkali metal or ammonium inorganic phosphate.

15. The composition of claim 14 consisting essentially of:

a. from 0.5% to 1.5% of the water-soluble phosphate;

b. from 3% to 6% of the water-soluble particulate alumina; and c. the balance water.

16. A method of cleaning a carpet and imparting a soil repellent finish thereto comprising the steps of:

1. applying an effective amount to the carpet of a substantially surfactant-free composition consisting essentially of:

a. from 0.2% to 4% of a water-soluble phosphate;

b. from 1% to 10% of a water-insoluble particulate alumina having an ultimate particle size less than 3 microns; and c. the balance water wherein the composition contains less than 1% surfactant based on the phosphate-alumina mixture; and 2. drying and vacuuming the carpet.

17. The method of claim 16 wherein the phosphate is an alkali metal or ammonium inorganic phosphate.

18. The method of claim 16 wherein the composition consists essentially of:

a. from 0.5% to 1.5% of the water-soluble phosphate;

b. from 3% to 6% of the alumina; and c. the balance water.

19. The method of claim 18 wherein the alumina has a particle size of from 0.005 microns to 0.1 microns.

20. The method of claim 19 wherein the phosphate is sodium tripolyphosphate.

21. The method of claim 20 wherein the composition is applied to the carpet at a rate of from 50 cc per square meter carpet to 1000 cc per square meter carpet.

22. The method of claim 16 wherein the composition is surfactant-free.

* * * * *